US005139906A

United States Patent [19]

Doi et al.

[11] Patent Number: 5,139,906

[45] Date of Patent: Aug. 18, 1992

[54] PHOTOSENSITIVE MEDIUM WITH A PROTECTIVE LAYER OF AMORPHOUS HYDROCARBON HAVING AN ABSORPTION COEFFICIENT GREATER THAN 10,000 $CM^{-1}$

[75] Inventors: Isao Doi, Toyonaka; Izumi Osawa, Ikeda; Shuji Iino, Hirakata; Kenji Masaki, Ibaraki, all of Japan

[73] Assignee: Minolta Camera Kabushiki Kaisha, Osaka, Japan

[21] Appl. No.: 619,426

[22] Filed: Nov. 29, 1990

[30] Foreign Application Priority Data

Nov. 30, 1989 [JP] Japan ..... 1-312961

[51] Int. Cl.[5] ..... G03G 5/14

[52] U.S. Cl. ..... 430/58; 430/59; 430/66

[58] Field of Search ..... 430/58, 59, 66, 67

[56] References Cited

U.S. PATENT DOCUMENTS 4,755,444 7/1988 Karakida et al. ..... 430/66
4,837,137 6/1989 Aizawa et al. ..... 430/65
4,882,256 11/1989 Osawa et al. ..... 430/66
4,886,724 12/1989 Masaki et al. ..... 430/66
4,891,291 1/1990 Masaki et al. ..... 430/66
4,891,292 1/1990 Masaki et al. ..... 430/66
4,939,056 7/1990 Hotomi et al. ..... 430/66
4,965,156 10/1990 Hotomi et al. ..... 430/66

FOREIGN PATENT DOCUMENTS 61-275852 12/1986 Japan .
61-275856 12/1986 Japan .

*Primary Examiner*—Marion E. McCamish
*Assistant Examiner*—S. Rosasco
*Attorney, Agent, or Firm*—Burns, Doane, Swecker & Mathis

[57] ABSTRACT

A photosensitive medium which comprises an electroconductive substrate, an organic photosensitive layer formed on the substrate and a surface protective layer formed on the photosensitive layer and including amorphous hydrocarbon. The surface protective layer has a first region overlaying the photosensitive layer and a second region overlaying the first region. The second region of the surface protective layer includes amorphous hydrocarbon having a light absorption coefficient at a wavelength of 450 nm which is greater than 10,000 $cm^{-1}$, and the first region of the surface protective layer includes amorphous hydrocarbon having a light absorption coefficient which is relatively smaller than that of the second region of the surface protective layer.

28 Claims, 4 Drawing Sheets

PHOTOSENSITIVE MEDIUM WITH A PROTECTIVE LAYER OF AMORPHOUS HYDROCARBON HAVING AN ABSORPTION COEFFICIENT GREATER THAN 10,000 $CM^{-1}$

BACKGROUND OF THE INVENTION

1. Field of the Invention

The present invention generally relates to a photosensitive medium and, more particularly, to the photosensitive medium having a surface protecting layer.

2. Description of the Prior Art

An organic photosensitive medium comprising an organic photoconductive material mixed with a binding resin is today widely employed. As compared with the photosensitive medium comprising selenium or cadmium sulfide, the organic photosensitive medium has advantages in that it poses no substantial hygienic problem and in that it can be manufactured on an industrial scale.

However, the organic photosensitive medium is low in hardness and does therefore tend to pose a problem in that, as a result of the repeated frictional contact with transfer papers, cleaning members, developing material and others, the photosensitive medium is apt to wear and/or be scratched.

To alleviate tha above discussed problem, a technique has been proposed to provide the organic photosensitive medium with a surface protective layer of high hardness. While amorphous hydrocarbon is known as a material for the surface protective layer having a high hardness, a mere formation of the surface protective layer, in the form of a film of amorphous hydrocarbon, on the organic photosensitive layer does not allow the organic photosensitive medium to exhibit a sufficient adhesive property and a durability and, therefore. the surface protective layer is apt to be peeled off from the organic photosensitive layer when repeatedly used for a substantial period of time.

Also, the film of amorphous hydrocarbon forming the surface protective layer is susceptible to deterioration in the presence of ozone and, therefore, when a copying is made under a high humidity environment, an image reproduced on a transfer paper tends to be blurred.

SUMMARY OF THE INVENTION

The present invention has been developed with a view to substantially eliminating the above discussed problems and is intended to provide an improved organic photosensitive medium wherein an improvement has been made in an adhesive property between an organic photosensitive layer and a surface protective layer and which can exhibit a high moisture resistance (a resistance to ozone) and a high durability.

BRIEF DESCRIPTION OF THE DRAWINGS

This and other objects and features of the present invention will become clear from the following description taken in conjunction with a preferred embodiment thereof with reference to the accompanying drawings, in which.

DETAILED DESCRIPTION OF THE EMBODIMENT

According to the present invention, there is provided a photosensitive medium which comprises an electroconductive substrate, an organic photosensitive layer formed on the substrate and a surface protective layer formed on the photosensitive layer and including amorphour hydrocarbon. The surface protective layer referred to above has a first region overlaying the photosensitive layer and a second region overlaying the first region. The second region of the surface protective layer includes amorphous hydrocarbon having a light adsorption coefficient at a wavelength of 450 nm which is greater than 10,000 $cm^{-1}$, and the first region of the surface protective layer includes amorphous hydrocarbon having a light absorpton coefficient which is relatively smaller than that of the second region of the surface protective layer.

As a result of research conducted to find an application of a film of amorphous hydrocarbon to an organic photosensitive medium, we have found that characteristics of the amorphous hydrocarbon film tend to vary considerably with coefficient of light absorption at 450 nm in wavelength (which coefficient is hereinafter referred to as "450 nm adsorption coefficient") and that the moisture resistance (the resistance to ozone) can be improved when the 450 nm adsorption coefficient is selected to be of a value greater than a predetermined value. Although the amorphous hydrocarbon film can exhibit an excellent moisture resistance, it is poor in adhesive property with an organic photosensitive layer and is therefore apt to be peeled off from the organic photosensitive layer. A further research we have conducted on the relationship between characteristics of the amorphous hydrocarbon film and the light adsorption coefficient has revealed that, when the 450 nm adsorption coefficient exhibited by amorphous hydrocarbon is reduced, the adhesive property between the amorphous hydrocarbon and the organic photosensitive layer can be improved. Based on this finding, the present invention is provided wherein the 450 nm adsorption coefficient exhibited by a surface region of the amorphous hydrocarbon film adjacent the organic photosensitive layer is selected to be smaller than that exhibited by an outermost surface region of the amorphous hydrocarbon film remote from the organic photosensitive layer thereby to provide the organic photosensitive medium having a surface protective layer exhibiting a satisfactory adhesive property relative to the organic photosensitive layer, a sufficient durability and an excellent moisture resistance.

In the practice of the present invention, the adsorption coefficient $\alpha_\lambda$ is defined as determined by the following equation:

$$\alpha_\lambda = -(1/D)\cdot\log_e(I_\lambda/I_{0\lambda})$$

wherein $\alpha_\lambda$ represents the adsorption coefficient at a wavelength $\lambda$, D represents a film thickness, and $I_\lambda/I_{0\lambda}$ represents the light transmissivity at the wavelength $\lambda$.

Figure 1:
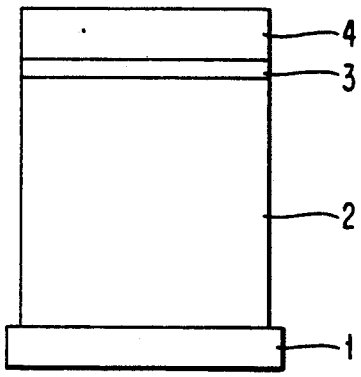
FIG. 1 is a schematic diagram showing a model of an organic photosensitive medium embodying the present invention.

Referring to FIG. 1, the organic photosensitive layer referred to above is identified by 2 and may be of any known composition formed on electroconductive support 1. This organic photosensitive layer 2 has an internal structure which may be either a single-layer structure made of a mixture of photoconductive material and a binder, a multi-layered structure wherein a charge generating layer and a charge transporting layer are sequentially stacked one above the other, or a multi-layered structure wherein a charge transporting layer and a charge generating layer are sequentially stacked one above the other.

The electroconductive support 1 may be of any suitable material provided that at least an outer surface thereof where the organic photosensitive layer is formed exhibits an electroconductive property. The electroconductive support 1 may have any suitable or desired shape, for example, in the form of a drum, a flexible belt, or a plate.

The surface protective layer provided according to the present invention may be of either a structure made up of first and second surface protective layers or a structure made up of first and second surface protective layer regions having no clear interface therebetween. In either of those structures, it is important in the practice of the present invention that the first surface protective layer or the first surface protective layer region (hereinafter, the both being collectively referred to as "first protective layer") and the second surface protective layer or the second surface protective layer region (hereinafter, the both being collectively referred to as "second protective layer") must have respective light adsorption coefficients as will be described later. It is, however, to be noted that the light adsorption coefficient may vary either progressively or stepwisely from the first protective layer to the second protective layer, and a minimum requirement to be satisfied in the practice of the present invention as far as the light absorption coefficient is concerned is that a surface region of the first protective layer adjacent the photosensitive layer 2 and a outermost surface region of the second protective layer remote from the photosensitive layer 2 must have respective predetermined light adsorption coefficients.

In FIG. 1, the first and second protective layers forming the surface protective layer according to the present invention are identified by 3 and 4, respectively. The first protective layer 3 includes amorphous hydrocarbon and serves to improve the adhesive property relative to the organic photosensitive layer 2. On the other hand, the second protective layer 4 includes amorphous hydrocarbon and serves to improve the moisture resistance.

The first protective layer 3 must have a 450 nm adsorption coefficient which is selected to be smaller than that of the second protective layer 4 and is of a value smaller than 10,000 $cm^{-1}$, preferably 9,000 $cm^{-1}$ or more preferably 6,000 $cm^{-1}$. If the 450 nm adsorption coefficient of the first protective layer 3 is greater than 10,000 $cm^{-1}$, the adhesive property of the organic photosensitive layer 2 will be reduced to such an extent as to result in an apt separation of the surface protective layer from the organic photosensitive layer 2. The first protective layer 3 has a film thickness within the range of 0.006 to 0.5 μm, preferably within the range of 0.01 to 0.2 μm. If this thickness is smaller than 0.006 μm, no sufficient adhesive property can be obtained and the durability will be reduced, but if the thickness is greater than 0.5 μm, a problem associated with an increase of a residue electric potential will occur.

The second protective layer 4 must have a 450 nm adsorption coefficient selected to be greater than 10,000 $cm^{-1}$, preferably 20,000 $cm^{-1}$ or more preferably 25,000 $cm^{-1}$. If the 450 nm adsorption coefficient of the second protective layer 4 is smaller than 10,000 $cm^{-1}$, a favorable moisture resistance after repetition cannot be obtained and an image will be blurred. This second protective layer 4 has a thickness within the range of 0.01 to 5 μm, preferably within the range of 0.04 to 1 μm or more preferably within the range of 0.08 to 0.5 μm. If this thickness is smaller than 0.01 μm, the film strength will be lowered to such an extent as to result in formation of scratches and/or a film separation. On the other hand, if the thicknes is greater than 5 μm, problems associated with a lowering of the sensitivity resulting from a reduction in light transmissivity, an increase of a residue electric potential, a lowering of the capability of film formation and deterioration of film adhesive property will occur.

It is to be noted that, in the practice of the present invention, the thickness of the surface protective layer is determined by the sum of the respective thicknesses of the first and second protective layers 3 and 4 is preferably within the range of 0.02 to 5 μm, preferably within the range of 0.04 to 1 μm or more preferably within the range of 0.08 to 0.5 μm. If the thickness of the surface protective layer is smaller than 0.02 μm, the film strength will be lowered to such an extent as to result in formation of scratches and/or a film separation. On the other hand, if the thickness of the surface protective layer is greater than 5 μm, problems associated with a lowering of the sensitivity resulting from a reduction in light transmissivity, an increase of a residue electric potential, a lowering of the capability of film formation and deterioration film adhesive property will occur.

In order to render the surface protective layer to exhibit a favorable light transmissivity, the light absorption coefficients of the first and second protective layers and their thicknesses must have the following relationship:

$$\alpha_1\cdot D_1+\alpha_2\cdot D_2 \leqq K$$

wherein $\alpha_1$ represents the 450 nm absorption coefficient of the first protective layer, $\alpha_2$ represents the 450 nm absorption coefficient of the second protective layer, $D_1$ represents the thickness of the first protective layer, $D_2$ represents the thickness of the second protective layer, and K is a constant which may be of a value equal to or smaller than 0.69, preferably equal to or smaller than 0.51 or more preferably equal to or smaller than 0.43.

Where the absorption coefficient varies progressively from the first protective layer to the second protective layer, the left term of the above equation will be an integrated value of the product of the absorption coefficient times the thickness.

It is to be noted that, where K=0.69, the light transmissivity of the surface protective layer takes a value of 50%; where K=0.51, it will take a value of 60%; and where K=0.43, it will take a value of 65%.

Although the amount of hydrogen atoms contained in the amorphous hydrogen film is not limited in the practice of the present invention, it will necessarily be limited by manufacturing parameters such as, for example, the specific structure of the surface protective layer and the glow discharge and will be limited to about 5 to 60 atomic %. The respective amounts of carbon atoms and hydrogen atoms both contained in the amorphous hydrocarbon film can be determined by any known method such as, for example, an organic element analysis, Auger's method or SIMS analysis.

The surface protective layer comprised of the first and second protective layers 3 and 4 is formed by the use of a grow discharge decomposition method. The surface protective layer can be formed in the form of an amorphous hydrocarbon film by the use of a so-called plasma reaction (hereinafter referred to as "P-CVD reaction") wherein molecules including at least carbon and hydrogen atoms in a gaseous phase are electrically discharged under a reduced atmosphere and active neutral species or electrically charged species contained in a resultant plasma atmosphere are then diffused, or induced by the effect of an electric force or magnetic force, onto a substrate so as to deposit on the substrate in a solid phase as a result of a recombination reaction occurring on the substrate.

Each of the above described molecules used in the practice of the present invention may not necessarily be in a gaseous phase at normal temperatures and normal pressures, and they may be either in a liquid phase or in a solid phase provided that they can be vaporized by melting, evaporation or sublimation when heated or placed under a reduced pressure.

The molecules including at least the carbon atoms and the hydrogen atoms may be employed in the form of any one of hydrocarbons such as, for example, saturated hydrocarbon, unsaturated hydrocarbon, alicyclic hydrocarbon or aromatic hydrocarbon.

The absorption coefficient of the amorphous hydrocarbon film can be controlled depending on conditions under which the film is formed, such as, for example, pressure, the frequency of an electric power source, the electric power, the type of raw gases used, the concentration of gases, the flow of gases and so on. Specifically, where the absorption coefficient of the surface protective layer is desired to be reduced, a reduction of energies used to form the film suffices and this can be accomplished by, for example, increasing the pressure, the frequency of the electric power, the amount of molecules of the raw gases, the concentration of the gases and/or the flow of the gases or by reducing the electric power. On the other hand, an increase of the absorption coefficient of the amorphous hydrocarbon film can be accomplished by employing a technique substantially reverse to that described above.

Hereinafter, the present invention willbe described in detail by way of illustrative examples.

(a) Preparation of Organic Photosensitive Layer A

A liquid mixture of 1 g chlorodian blue (CDB) as a biszao pigment, 1 g polyester resin (manufactured and sold under a tradename "V-200" by Toyobo Co., Ltd. of Japan) and 98 g cyclohexane was dispersed for 13 hours with the use of a sand grinder. The resultant suspension was coated on a surface of an aluminum substrate, 50×50×3 mm in size, with the use of a bar coater and the coating was subsequently dried to form a charge generating layer of 0.3 μm in thickness.

Thereafter, 5 g 4-diethylaminobenzaldehyde-diphenylhydrazone (DEH) and 5 g polycarbonate (sold and manufactured under a tradename "K-1300" by Teijin Kasei Co., Ltd. of Japan) were dissolved into 30 g THF. The resultant solution was coated on the charge generating layer and the coating was subsequently dried to form a charge transporting layer of 15 μm in thickness, thereby providing an organic photosensitive layer Ap.

Using a method similar to that described above, an organic photosensitive layer Ad was formed on a cylindrical aluminum substrate of 80 mm in diameter and 330 mm in length with the use of a dipping technique.

The resultant organic photosensitive layer Ap was electrically charged to −600 volts by means of a corona discharge during an execution of a Carlson process and was subsequently measured as to the amount of white light required to reduce the surface potential by half (hereinafter referred to as "$E_{\frac{1}{2}}$amount"). The measured $E_{\frac{1}{2}}$amount was 2.0 lux per second and the residual potential was −5 volt. Also, the organic photosensitive layer Ap was found having a surface hardness rating of approximately 5 B based on the measurements for pencil lead hardness as stipulated in JIS K-5400.

The organic photosensitive layer Ad obtained as described above showed results similar to those described above in connection with the organic photosensitive layer Ap.

(b) Preparation of Organic Photosensitive Layer B

Except that methyl methacrylate PMMA (manufactured and sold under a tradename "BR-35" by Mitsubishi Rayon Co., Ltd. of Japan) was substituted for the polycarbonate used during the formation of the charge transporting layer in the organic photosensitive layer A, organic sensitive layers Bp and Bd were prepared in manners similar to the respective preparation of the organic photosensitive layers Ap and Ad.

The organic photosensitive layer Bp was electrically charged to −600 volts by means of a corona discharge during an execution of a Carlson process and was subsequently measured as to the $E_{\frac{1}{2}}$amount. The measured $E_{\frac{1}{2}}$amount was 6.2 lux per second and the residual potential was −12 volt. Also, the organic photosensitive layer Bp was found having a surface hardness rating of approximately B based on the JIS K-5400 measurement.

The organic photosensitive layer Bd also showed results similar to those described above in connection with the organic photosensitive layer Bp.

(c) Preparation of Organic Photosensitive Layer C

Except that polyacrylate (manufactured and sold under a tradename "U-100" by Unichika Co., Ltd. of Japan). was substituted for the polycarbonate used during the formation of the charge transporting layer in the organic photosensitive layer A, organic sensitive layers Cp and Cd were prepared in manners similar to the respective preparation of the organic photosensitive layers Ap and Ad.

The organic photosensitive layer Cp was electrically charged to −600 volts by means of a corona discharge during an execution of a Carlson process and was subsequently measured as to the $E_{\frac{1}{2}}$amount. The measured $E_{\frac{1}{2}}$amount was 2.3 lux per second and the residual potential was −8 volt. Also, the organic photosensitive layer Bp was found having a surface hardness rating of approximately 5 B based on the JIS K-5400 measurement.

The organic photosensitive layer Cd also showed results similar to those described above in connection with the organic photosensitive layer Cp.

(d) Preparation of Organic Photosensitive Layer D

A liquid mixture of 25 parts by weight of special α-type copper phthalocyanine (manufactured and sold by Toyo Ink Co., Ltd. of Japan), 50 parts by weight of acrylmelamine thermosetting resin (a mixture of A-405 and Super Bekkamin J820, which is manufactured and sold by Dainippon Ink Co., Ltd. of Japan), 25 parts by weight of 4-diethylaminobenzaldehyde-diphenylhydrazone, and 500 parts by weight of organic solvent (a mixture of 7 parts by weight of xylene and 3 parts by weight of butanol) was pulverized and dispersed in a ball mill for 10 hours. The resultant suspension was coated on a surface of an aluminum substrate, 50×50×3 mm in size, with the use of a bar coater and the coating was subsequently dried and baked for 1 hour at 150° C. to form an organic photosensitive layer Dp.

Using a method similar to that described above, and organic photosensitive layer Dd was formed on a cylindrical aluminum substrate of 80 mm in diameter and 330 mm in length with the use of a dipping technique.

The resultant organic photosensitive layer Dp was electrically charged to +600 volts by means of a corona discharged during an execution of a Carlson process and was subsequently measured as to the $E_{\frac{1}{2}}$amount. The measured $E_{\frac{1}{2}}$amount was 4.3 lux per second and the residual potential was +5 volt. Also, the organic photosensitive layer Dp was found having a surface hardness rating of approximately 5 B based on the JIS K-5400 measurement.

The organic photosensitive layer Ad also showed results similar to those described above in connection with the organic photosensitive layer Dp.

EXPERIMENT 1

The surface protecting layer for the photosensitive medium was formed by the use of a grow discharge decomposition device shown in FIG. 6 in the following manner.

After a reaction chamber 733 had been evacuated to a high vacuum of about $10^{-5}$ Torr, first, second and third pressure regulator valves 707, 708 and 709 were opened to allow the flow of a 1.3-butadiene gas, a hydrogen gas and 4 fluorinated methane gas from first, second and third tanks 701, 702 and 703 into first, second and third flow regulators 713, 714 and 715, respectively. The first to third pressure regulator valves 707 to 708 had been adjusted so as to allow those gases to emerge therefrom at a respective pressure of 1.5 kg/cm$^2$. The flow regulators 713 to 715 were calibrated so as to allow the 1,3-butadiene gas, the hydrogen gas and the 4-fluorinated methane gas to flow at respective rates of 15 sccm, 300 sccm and 90 sccm. Those gases emerging from the flow regulators 713 to 715 were then supplied into the reaction chamber 733 through a main line 732 via a mixing unit 731. After the respective flow rates of those gases had been stabilized, a pressure regulator valve 745 was adjusted to evacuate the reaction chamber 733 to 0.5 Torr.

As a substrate 752 placed within the reaction chamber 733, Ad provided with the photosensitive layer was used. This substrate 752 was heated for about 15 minutes to elevate its temperature from normal temperature to 50° C. before the introduction of the above described gases. After the respective flow rates and the respective pressures of the above described gases had been stabilized, a high frequency electric power source 739 connected with a connection selector switch 744 was powered on to apply an electric power of 150 Watts at 13.56 MHz to a power applying electrode 736, thereby to effect a plasma polymerization for about 2.5 minutes to form the surface protective layer in the form of amorphous hydrocarbon film of 0.09 μm in thickness.

Characteristics

Figure 5:
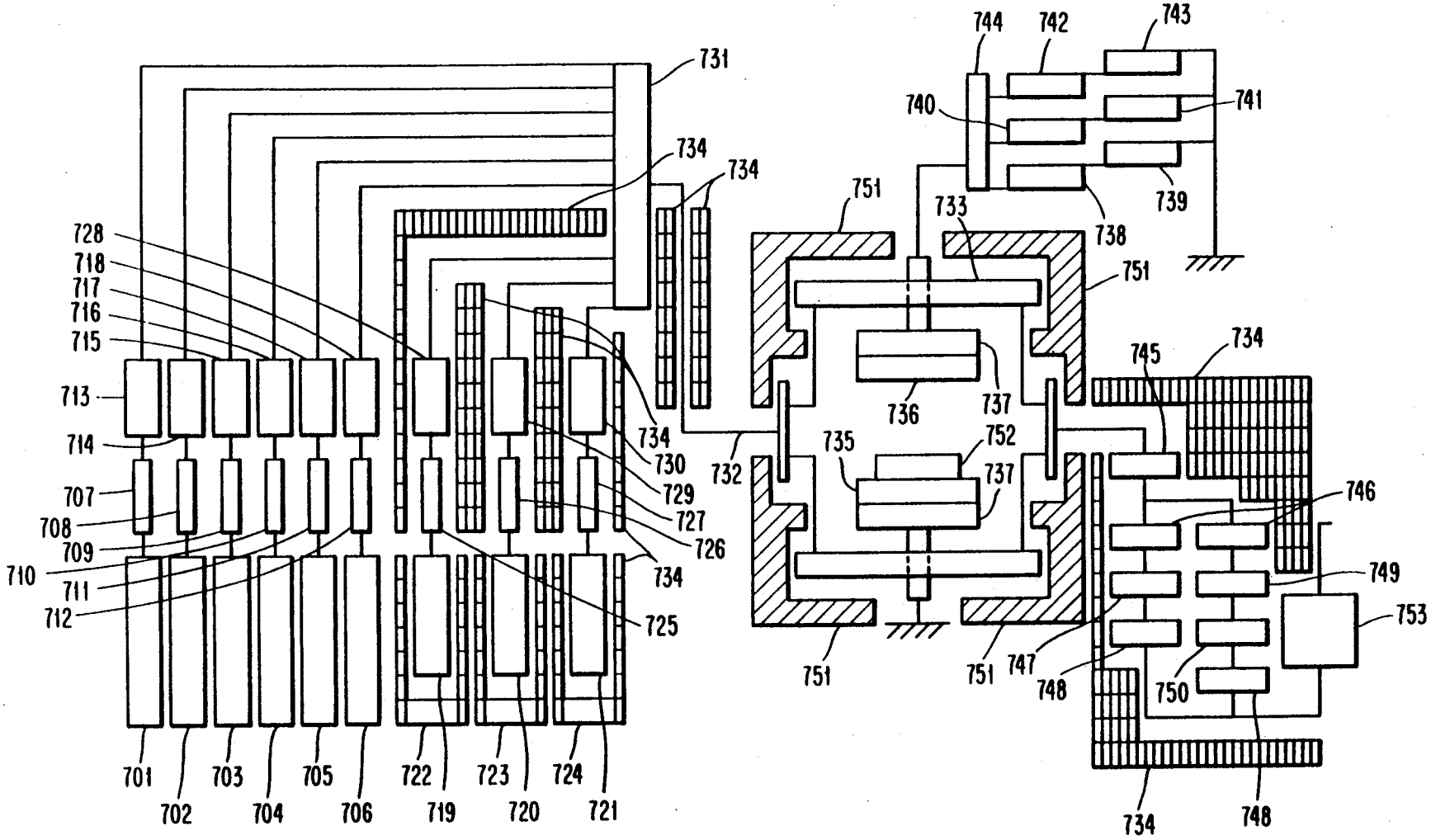
FIGS. 5 and 6 are schematic diagrams showing grow discharge decomposition apparatus, respectively.

In a method similar to the above described method except that a plate glass (manufactured and sold under a tradename "#7059" by Corning Glass Works of U.S.A., 28×30×1.1 mm in size) was used as the substrate 752, the surface protective layer was formed on the plate glass with the use of the grow discharge decomposition apparatus shown in FIG. 5. When the 450 nm absorption coefficient was determined using the light transmissivity measured at the wavelength of 450 nm (with the use of a visible-ultraviolet spectrophotometer manufactured and sold under a tradename "UVIDEC-610" by Nippon Bunko Kogyo Kabushiki Kaisha of Japan) and the measured film thickness, the 450 nm absorption coefficient was found about 296 cm$^{-1}$. The adhesive property of the surface protective layer in the photosensitive medium was also evaluated according to the cross-cut adhesion test method stipulated in JIS-K5400 and was found to have been rated 10 points, indicating that the adhesive property between the surface protective layer and the photosensitive layer was very good.

Figure 2:
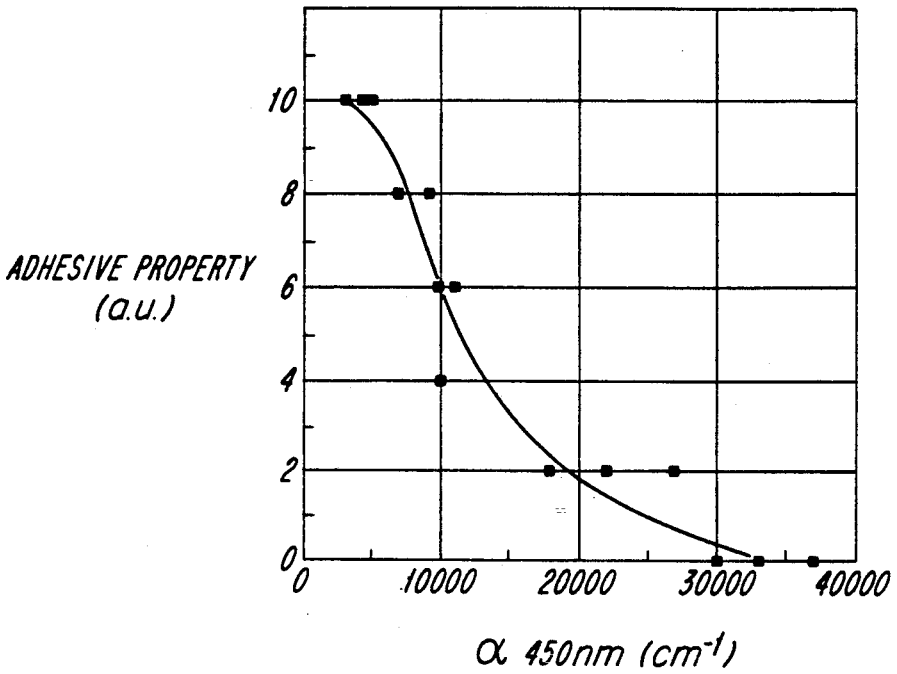
FIG. 2 is a graph showing the relationship between the coefficient of light absorption $\alpha_{450nm}$ and the adhesive property shown in terms of points of evaluation given during a cross-cut adhesion test that was conducted according to JIS-K 5400 provisions of the Japanese Industrial Standards (JIS)

Also, using such other manufacturing conditions as tabulated in Table 1, the surface protective layers having different 450 nm absorption coefficients were prepared. Respective characteristics (film thickness, light transmissivity and 450 nm absorption coefficient) and respective evaluation points given by the cross-cut adhesion test method are tabulated in Table 1. A relationship between each 450 nm absorption coefficient and the adhesive property is shown in FIG. 2.

TABLE 1

| Plot | a-C Surface Protective Coating Mfg. Conditions & Characteristics | | | | | | | | | | | | JIS-K5400 Adhesion Test | |
|---|---|---|---|---|---|---|---|---|---|---|---|---|---|---|
| | Gas Flow (sccm) | | | | | Freq. | Power | | Filming | Thickness | Transmis- | Coefficient α | | |
| No. | $CH_4$ | $C_3H_6$ | $C_4H_6$ | $CF_4$ | $H_2$ | (KHz) | (W) | Torr | Time (min) | (μm) | sivity (%) | at 450 nm (cm$^{-1}$) | Points | |
| 1 | | | 15 | 90 | 300 | 13,560 | 150 | 0.5 | 2.5 | 0.09 | 97 | 2,960 | ○ | 10 |
| 2 | | | 15 | | 300 | 80 | 150 | 1 | 3 | 0.075 | 97 | 4,130 | ○ | 10 |
| 3 | | | 15 | 90 | | 80 | 150 | 0.5 | 1.5 | 0.08 | 97 | 4,430 | ○ | 10 |
| 4 | | | 15 | | 300 | 80 | 100 | 0.5 | 4 | 0.1 | 93 | 6,960 | ○ | 8 |
| 5 | | | 15 | 90 | 300 | 100 | 150 | 0.5 | 3.5 | 0.09 | 92 | 8,910 | ○ | 8 |
| 6 | | | 15 | 90 | 300 | 80 | 180 | 0.4 | 3.2 | 0.075 | 93 | 9,700 | Δ | 6 |
| 7 | | | 15 | 90 | 300 | 80 | 200 | 0.4 | 3.5 | 0.085 | 92 | 10,000 | Δ | 4 |
| 8 | | | 15 | | 300 | 80 | 200 | 0.5 | 4 | 0.09 | 91 | 10,900 | Δ | 6 |
| 9 | 60 | | | | 50 | 100 | 200 | 0.5 | 7 | 0.08 | 86 | 18,200 | X | 2 |

TABLE 1-continued

| Plot No. | a-C Surface Protective Coating Mfg. Conditions & Characteristics: Gas Flow (sccm) $CH_4$ | $C_3H_6$ | $C_4H_6$ | $CF_4$ | $H_2$ | Freq. (KHz) | Power (W) | Torr | Filming Time (min) | Thickness (μm) | Transmissivity (%) | Coefficient α at 450 nm ($cm^{-1}$) | JIS-K5400 Adhesion Test Points | |
|---|---|---|---|---|---|---|---|---|---|---|---|---|---|---|
| 10 | | | 15 | | 300 | 80 | 150 | 0.4 | 4.5 | 0.11 | 79 | 21,960 | X | 2 |
| 11 | | 20 | | | 300 | 100 | 150 | 0.5 | 8 | 0.08 | 81 | 27,000 | X | 2 |
| 12 | | | 15 | | 300 | 80 | 150 | 0.3 | 3.75 | 0.09 | 76 | 30,000 | X | 0 |
| 13 | | | 15 | | 300 | 80 | 150 | 0.3 | 2.8 | 0.08 | 77 | 33,040 | X | 0 |
| 14 | | | 15 | | 300 | 80 | 150 | 0.25 | 4 | 0.1 | 69 | 37,130 | X | 0 |

Referring to the graph of FIG. 2, it has been confirmed that, while the adhesive property thereof relative to the organic photosensitive layer is poor where the 450 nm absorption coefficient of the surface protective layer is greater than 20,000 $cm^{-1}$, the adhesive property increases with decrease of the 450 nm absorption coefficient and, when the 450 nm absorption coefficient attains a value smaller than 10,000 $cm^{-1}$, preferably smaller than 6,000 $cm^{-1}$, an excellent adhesive property could be obtained.

EXPERIMENT 2

Figure 6:
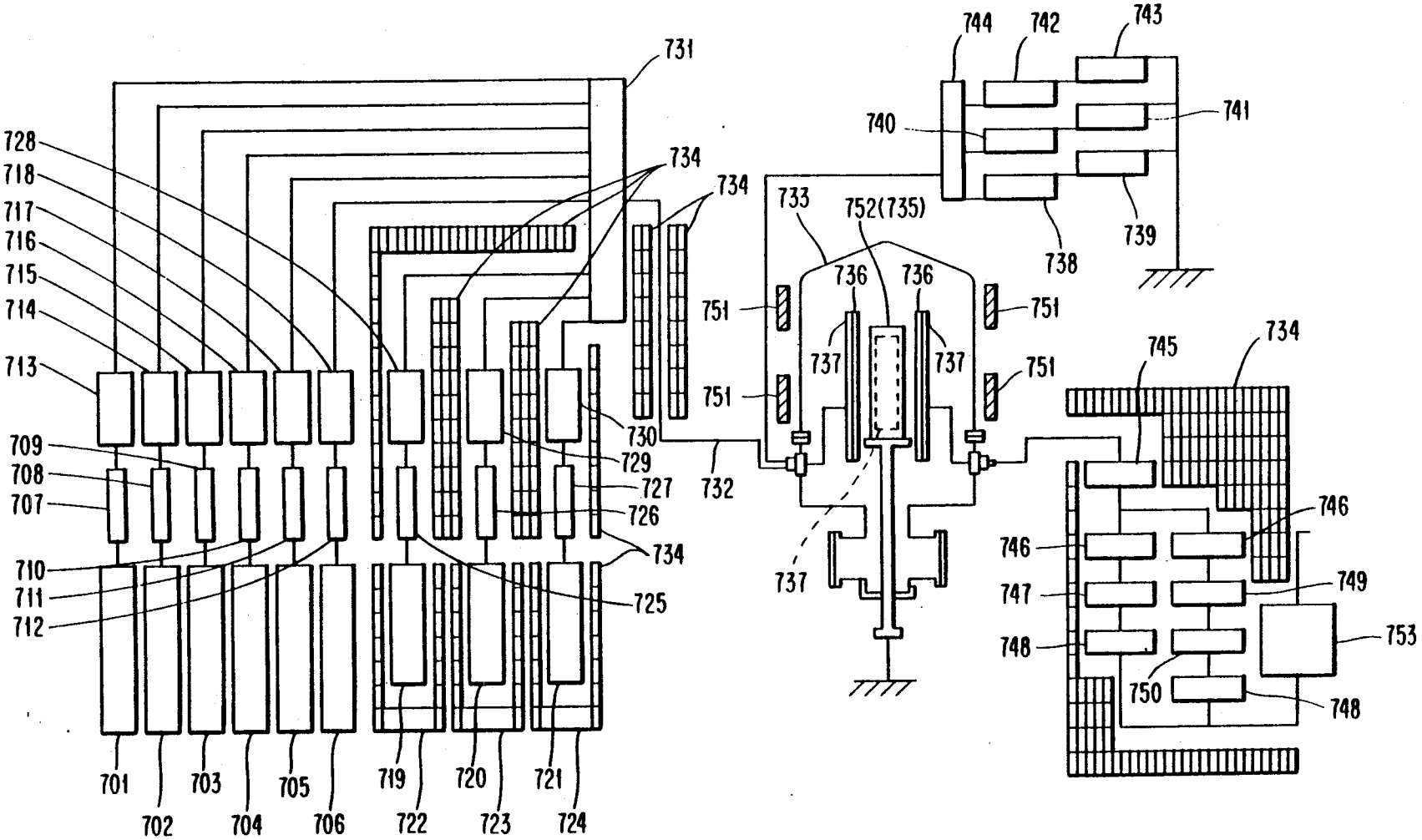

With the use of the grow discharge decomposition apparatus shown in FIG. 6, and also with the use of the cylindrical organic photosensitive layer Ad as a substrate, first surface protective layers were formed under the following conditions.

| | |
|---|---|
| Gas Flow: | $C_4H_6$ . . . 15 sccm |
| | $H_2$ . . . 300 sccm |
| Frequency: | 80 KHz |
| Power: | 150 Watts |
| Pressure: | 1 Torr |
| Filming Time: | 0.75 minutes |

Each of the resultant first surface protective layers has shown that the 450 nm absorption coefficient thereof was about 4,000 $cm^{-1}$ and the film thickness thereof was 0.02 μ m.

Second surface protective layers having different 450 nm absorption coefficients were subsequently formed over the respective first surface protective layers under associated conditions as tabulated in Table 2, thereby to complete respective photosensitive mediums.

Each of the resultant photosensitive mediums was installed in an electrophotographic copying machine, EP-650Z manufactured and sold by the assignee of the present invention and was subjected to repeated copying cycles. Thereafter, actual copies were made under high temperature, high humidity atmosphere of 30° C. in temperature and 85% in relative humidity. The maximum number of those copies in which no image blurring was observed is also known in Table 2 for each resultant photosensitive medium.

Figure 3:
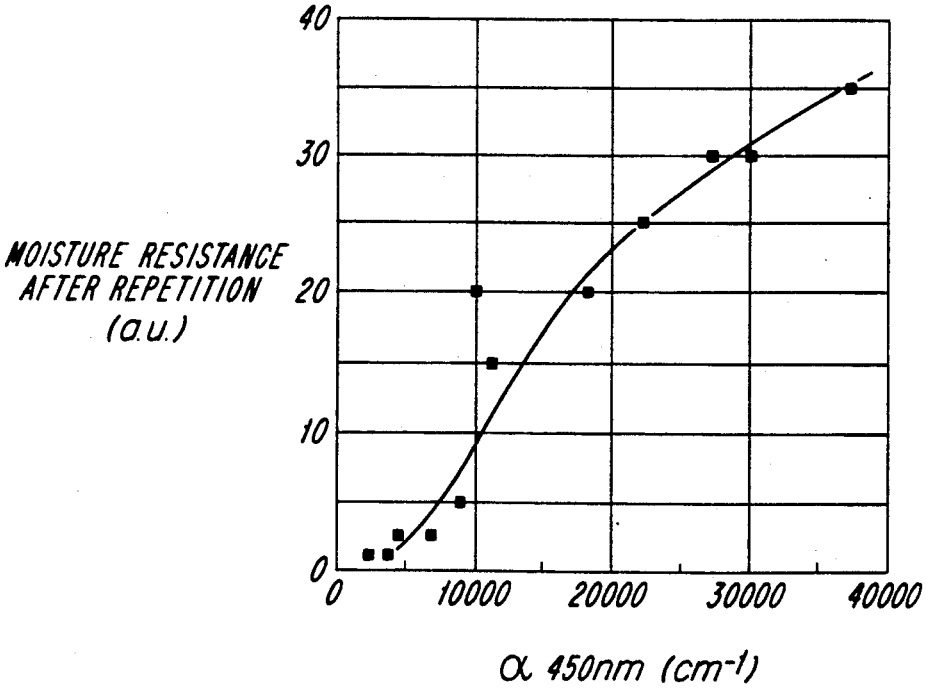
FIG. 3 is a graph showing the relationship between the coefficient of light absorption $\alpha_{450nm}$ and the moisture resistance after repetition.

The relationship between those results and the respective 450 nm absorption coefficient is shown in the graph of FIG. 3. Referring to the graph of FIG. 3, it has been confirmed that, when the 450 nm absorption coefficient of the second surface protective layer is about 5,000 $cm^{-1}$, an image blurring will be observed after 25,000 copies have been made, and that, when the 450 nm absorption coefficient is 10,000 $cm^{-1}$ and 20,000 $cm^{-1}$, no image blurring could be observed before 100,000 copies and about 200,000 copies were made, respectively. Thus, it is clear that, when the 450 nm absorption coefficient is selected to be of a value equal to or greater than 10,000 $cm^{-1}$, the moisture resistance of the photosensitive medium can be advantageously improved.

TABLE 2

| Plot No. | a-C Surface Protective Coating Mfg. Conditions & Characteristics: Gas Flow (sccm) $CH_4$ | $C_3H_6$ | $C_4H_6$ | $CF_4$ | $H_2$ | Freq. (KHz) | Power (W) | Torr | Filming Time (min) | Thickness (μm) | Transmissivity (%) | Coefficient α at 450 nm ($cm^{-1}$) | Moisture Resistance: Maximum No. of Actual Copies | |
|---|---|---|---|---|---|---|---|---|---|---|---|---|---|---|
| 1 | | | 15 | 90 | 300 | 13,560 | 150 | 0.5 | 2.5 | 0.09 | 97 | 2,960 | X | 10,000 |
| 2 | | | 15 | | 300 | 80 | 150 | 1 | 3.5 | 0.095 | 96 | 3,910 | X | 10,000 |
| 3 | | | 15 | 90 | | 13,560 | 100 | 0.35 | 5 | 0.11 | 95 | 4,520 | X | 25,000 |
| 4 | | | 15 | | 300 | 80 | 100 | 0.5 | 4 | 0.09 | 94 | 6,960 | X | 25,000 |
| 5 | | | 15 | | 300 | 13,560 | 250 | 0.5 | 3.5 | 0.09 | 92 | 8,960 | X | 50,000 |
| 6 | | | 15 | 90 | 300 | 80 | 200 | 0.4 | 3.5 | 0.085 | 92 | 10,000 | Δ | 200,000 |
| 7 | | | 15 | 90 | 300 | 80 | 200 | 0.5 | 3.5 | 0.09 | 91 | 10,900 | Δ | 150,000 |
| 8 | 60 | | | | 50 | 100 | 200 | 0.5 | 7 | 0.08 | 86 | 18,200 | Δ | 200,000 |
| 9 | | | | | 300 | 80 | 150 | 0.4 | 4.5 | 0.11 | 79 | 21,960 | ○ | 250,000 |
| 10 | | 20 | | | 300 | 100 | 150 | 0.5 | 8 | 0.08 | 81 | 27,000 | ○ | 300,000 |
| 11 | | | 15 | | 300 | 80 | 150 | 0.3 | 3.75 | 0.09 | 76 | 30,000 | ○ | 300,000 |
| 12 | | | 15 | | 300 | 80 | 150 | 0.25 | 4 | 0.1 | 69 | 37,130 | ○ | 350,000 |

EXAMPLE 1

The surface protecting layer for the photosensitive medium was formed by the use of the grow discharge decomposition device shown in FIG. 5 in the following manner.

After a reaction chamber 733 had been evacuated to a high vacuum of about $10^{31\ 5}$ Torr, first and second pressure regulator valves 707 and 708 were opened to allow the flow of a 1,3-butadiene gas and a hydrogen gas from first and second tanks 701 and 702 into first and second flow regulators 713 and 714, respectively. The first and second pressure regulator valves 707 and 707 had been adjusted so as to allow those gases to emerge therefrom at a respective pressure of 1.5 kg/$cm^2$. The flow regulators 713 and 714 were calibrated so as to allow the 1,3-butadiene gas and the hydrogen gas to flow at respective rates of 15 sccm and 300 sccm. Those gases emerging from the flow regulators 713 and 714 were then supplied into the reaction chamber 733 through a main line 732 via a mixing unit 731. After the respective flow rates of those gases had been stabilized, a pressure regulator valve 745 was adjusted to evacuate the reaction chamber 733 to 1 Torr.

As a substrate 752 placed within the reaction chamber 733, Ap provided with the photosensitive layer was used. This substrate 752 was heated for about 15 minutes to elevate its temperature from normal temperature to 50° C. before the introduction of the above described gases. After the respective flow rates and the respective pressures of the above described gases had been stabilized, a low frequency electric power source 741 connected with a connection selector switch 744 was powered on to apply an electric power of 150 Watts at 80 KHz to a power applying electrode 736, thereby to effect a plasma polymerization for about 0.75 minutes to form on the substrate 752 a first surface protective layer in the form of amorphous hydrocarbon film of 0.09 μm in thickness.

After the formation of the first surface protective layer referred to above, and after the pressure regulator valve 745 had been adjusted to allow the pressure to continuously vary from 1 Torr to 0.3 Torr in about 15 seconds without the application of the electric power being interrupted, the plasma polymerization was effected for about 3 minutes to form over the first surface protective layer a second surface protective layer in the form of an amorphous hydrocarbon film of about 0.08 μm.

After the filming effected in this manner, the application of the electric power was interrupted and the regulator valves associated with gases other than the hydrogen gas were closed while only the hydrogen gas was permitted to flow into the reaction chamber 733 at a rage of 100 sccm. At the same time, the pressure regulator valve 745 was adjusted to maintain the pressure of about 10 Torr while the temperature was allowed to decrease to about 30° C. in about 30 minutes. Thereafter, the regulator valve associated with the hydrogen gas was closed and the reaction chamber 733 was ventilated to establish the atmospheric pressure, followed by the removal of the photosensitive medium of the present invention out from the reaction chamber 733.

Characteristics

In a method similar to the above described method except that a plate glass (manufactured and sold under a tradename "#7059" by Corning Glass Works of U.S.A., 28×30×1.1 mm in size) was used as the substrate 752, the first and second surface protective layers were formed on the plate glass with the use of the grow discharge decomposition apparatus shown in FIG. 5. When the 450 nm absorption coefficient was determined using the light transmissivity measured at the wavelength of 450 nm (with the use of a visible-ultraviolet spectrophotometer manufactured and sold under a tradename "UVIDEC-610" by Nippon Bunko Kogyo Kabushiki Kaisha of Japan) and the measured film thickness, the first surface protective layer exhibited the 450 nm absorption coefficient of about 4,000 and the second surface protective layer exhibited the 450 nm absorption coefficient of about 3,300.

Figure 4:
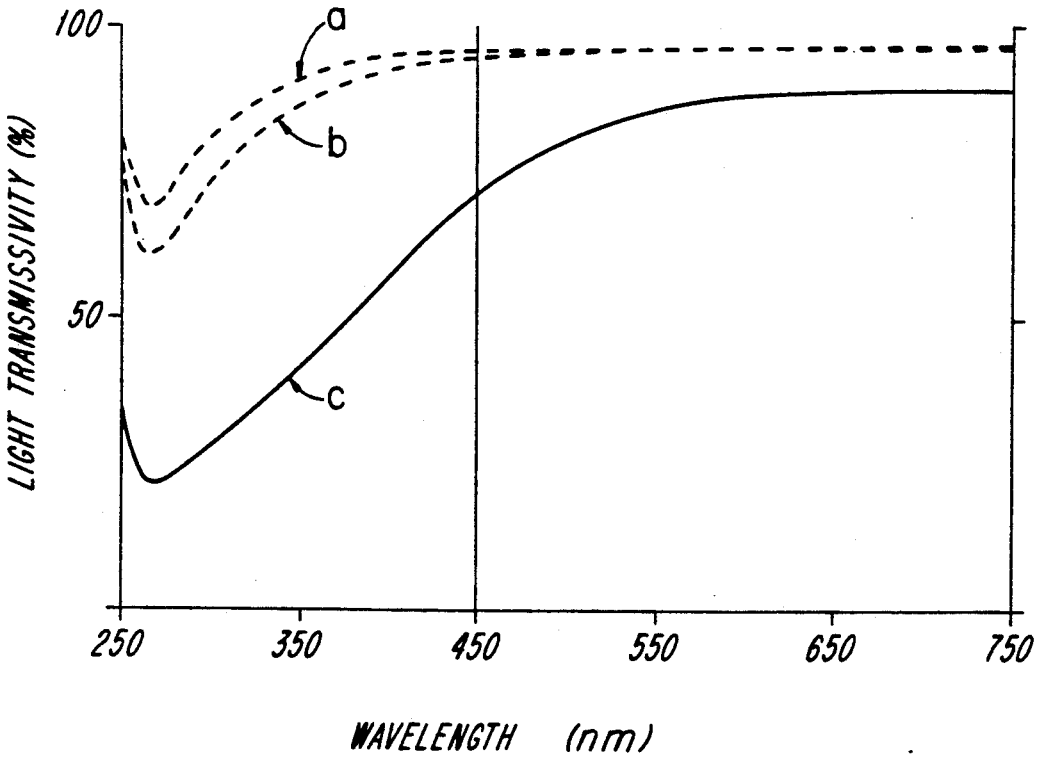
FIG. 4 is a chart showing the spectrum of adsorption of visible light according to the embodiment of the present invention.

The absorption spectrum of the second surface protective layer relative to the visible wavelength range is shown by (c) in the graph of FIG. 4.

When the surface hardness of the resultant photosensitive medium was measured according to the measurements for pencil lead hardnesss as stipulated in JIS K-5400, the surface hardness rating of a portion of the photosensitive medium where the surface protective layer was bonded was found to be approximately 9H. Thus, it is clear that the surface of the photosensitive medium could be increased in surface hardness according to the present invention. Also, the photosensitive medium so manufactured has exhibited a sensitivity characteristic similar to that exhibited by the photosensitive layer Ap used as the substrate 752 and, therefore, it is clear that the surface protective layer formed according to the present invention would not adversely affect the sensitivity peculiar to the photosensitive medium.

Also, according to results of the JIS-K4500 cross-cut adhesion test, the photosensitive medium so manufactured gained 10 points, showing an excellent adhesive property obtained between the photosensitive layer and the surface protective layer.

Furthermore, when the photosensitive medium so manufactured was allowed to stand for 6 hours in the environment whre the atmosphere of 10° C. in temperature and 30% in relative humidity and the atmosphere of 50° C. and 90% in relative humidity alternated at intervals of 30 minutes, neither separation of the surface protective layer from the photosensitive layer nor any decomposition were found and, therefore, it is clear that the surface protective layer was firmly bonded to the photosensitive layer according to the present invention.

The various results discussed above are tabulated in Table 4. It is to be noted that in Table 4, the sensitivity characteristic is marked by a circle (O) when the sensitivity characteristic was found not impaired and by a cross (X) when it was found impaired.

Results of the environmental test in which the photosensitive medium was allowed to stand for 6 hours in the environment where the atmosphere of 10° C. in temperature and 30% in relative humidity and the atmosphere of 50° C. and 90% in relative humidity alternated at intervals of 30 minutes are indicated by a circle (O) if neither separation of the surface protective layer nor the cracking were found not occurring and by a cross (X) when they were found occurring.

EXAMPLES 2 TO 4

Except that such manufacturing conditions as tabulated in Table 3 were employed in place of those employed in Example 1, photosensitive mediums each having the first and second surface protective layers were manufactured according to a method similar to that employed in Example 1.

Characteristics

The 450 nm absorption coefficient of each of the resultant photosensitive mediums was determined by a method similar to that employed in Example 1. The absorption spectrum of the first surface protective layer in each of Examples 2 and 3 relative to the visible wavelength range is shown by (a) or (b) in the graph of FIG. 4, respectively.

As was the case with the photosensitive medium in Example 1, each of the photosensitive mediums in Example 2 to 4 was tested as to surface hardness, sensitivity characteristic, adhesive property and environmental resistance in respective methods similar to those described in Example 1, and result of those tests are tabulated in Table 4.

EXAMPLES 5 TO 8

Except that cylindrical substrates were employed as the substrate and that such manufacturing conditions as tabulated in Table 3 were employed in place of those employed in Example 1, photosensitive mediums each having the first and second surface protective layers were manufactured with the use of the apparatus of FIG. 6 according to a method similar to that employed in Example 1.

Characteristics

The 450 nm absorption coefficient of each of the resultant photosensitive mediums was determined by a method similar to that employed in Example 1.

When each of the resultant photosensitive mediums was installed in the copying machine, EP-650Z manufactured and sold by the assignee of the present invention, to evaluate actual copies obtained, clearly reproduced images were observed on the copies. Also, even when copies were made under the high-temperature, high-humidity atmosphere of 30° C. in temperature and 85% in relative humidity, no image blurring was observed. (Initial Copy Evaluation)

Also, no separation of the surface protective layer from the photosensitive layer was found even though it was brought into frictional contact with a developer, transfer papers, cleaning members and others within the copying machine.

Furthermore, when an actual image copying was performed until 300,000 copies were obtained in case of Examples 5 and 6 or until 350,000 copies were obtained in case of Examples 7 and 8, a clear image could be reproduced to the last copy with no reduction in film thickness of the photosensitive layer observed, and no image blurring was found even when the actual image copying had been performed under the high-temperature, high-humidity atmosphere of 30° C. in temperature and 85% in relative humidity. (Copy Evaluation After Repetition).

The various results discussed above are tabulated in Table 4. It is to be noted that in Table 4, the initial copy evaluaton is marked by a circle (O) when the copy was found satisfactory with no film separation and no image blurring occurring under the high-temperature, high-humidity environment and by a cross (X) when, after severa hundred cycles of actual copying operation, a plurality of line-shaped traces of separation were found in a direction circumferentially of each of the photosensitive mediums. The copy evaluation after repetition is indicated by a circle (O) when a clear image reproduction was accomplished with no reduction in thickness of the photosensitive layer and also with no image blurring occurring under the high-temperature, high-humidity environment, even after the frictional contact with 300,000 papers (or 350,000 papers in case of Examples 7 and 8).

TABLE 3

| | | Surface Protective Layer Mfg. Conditions & Characteristics | | | | | | | | | | | | |
|---|---|---|---|---|---|---|---|---|---|---|---|---|---|---|
| | Type of Pro- | Gas Flow (sccm) | | | | | Freq. | Power | | Filming | Thickness | Type of | Shape of | Appa- |
| Nos. | tective Layer | $CH_4$ | $C_3H_6$ | $C_4H_6$ | $CF_4$ | $H_2$ | (KHz) | (W) | Torr | Time (min) | (μm) | Substrate | Substrate | ratus used |
| 1 | 1st Layer | | | 15 | | 300 | 80 | 150 | 1 | 0.75 | 0.02 | Ap | Flat | FIG. 5 |
| | 2nd Layer | | | 15 | | 300 | 80 | 150 | 0.3 | 3 | 0.08 | | | |
| 2 | 1st Layer | | | 15 | 90 | 300 | 13,560 | 150 | 0.5 | 0.6 | 0.024 | Bp | Flat | FIG. 5 |
| | 2nd Layer | | | 15 | | 300 | 80 | 100 | 0.22 | 5 | 0.1 | | | |
| 3 | 1st Layer | | | 15 | | 300 | 13,560 | 100 | 0.22 | 2 | 0.024 | Cp | Flat | FIG. 5 |
| | 2nd Layer | 60 | | | | 50 | 100 | 150 | 0.5 | 5 | 0.065 | | | |
| 4 | 1st Layer | | | 15 | | | 80 | 150 | 0.5 | 0.2 | 0.023 | Dp | Flat | FIG. 5 |
| | 2nd Layer | | 20 | | | 300 | 100 | 150 | 0.5 | 8 | 0.08 | | | |
| 5 | 1st Layer | | | 15 | | 300 | 80 | 150 | 1 | 0.75 | 0.02 | Ad | Cylindrical | FIG. 6 |
| | 2nd Layer | | | 15 | | 300 | 80 | 150 | 0.3 | 3 | 0.08 | | | |
| 6 | 1st Layer | | | 15 | | 300 | 80 | 150 | 1 | 0.75 | 0.02 | Bd | Cylindrical | FIG. 6 |
| | 2nd Layer | | | 15 | | 300 | 80 | 150 | 0.3 | 3 | 0.08 | | | |
| 7 | 1st Layer | | | 15 | 90 | 300 | 13,560 | 150 | 0.5 | 0.6 | 0.024 | Cd | Cylindrical | FIG. 6 |
| | 2nd Layer | | | 15 | | 300 | 80 | 100 | 0.22 | 5 | 0.1 | | | |
| 8 | 1st Layer | | | 15 | 90 | 300 | 13,560 | 150 | 0.5 | 0.6 | 0.024 | Dd | Cylindrical | FIG. 6 |
| | 2nd Layer | | | 15 | | 300 | 80 | 100 | 0.22 | 5 | 0.1 | | | |
| 1 | Single Layer | | | 15 | | 300 | 80 | 150 | 0.3 | 3 | 0.08 | Ad | Cylindrical | FIG. 6 |
| 2 | Single Layer | | | 15 | | 300 | 80 | 100 | 0.22 | 5 | 0.1 | Bd | Cylindrical | FIG. 6 |
| 3 | Single Layer | | 20 | | | 300 | 100 | 150 | 0.5 | 8 | 0.08 | Dd | Cylindrical | FIG. 6 |

TABLE 4

| | | Characteristics & Evaluations of Surface Protective Layer | | | | | | | Copy Evaluation | |
|---|---|---|---|---|---|---|---|---|---|---|
| Nos. | Type of Pro- tective Coat. | Transmis- sivity I (%) | Coefficient at 450 nm α1, α2 (cm−1) | $\alpha_1 \cdot D_1 + \alpha_2 \cdot D_2$ | Hard- ness | Sensi- tivity | Adhesive Property | Results of Environmental Tests | Initial | After Repetition |
| 1 | 1st Layer | 99 | 4,000 | 0.27 | 9 H | O | 10 | O | — | — |
| | 2nd Layer | 77 | 33,000 | | | | | | | |
| 2 | 1st Layer | 99 | 3,000 | 0.36 | 9 H | O | 10 | O | — | — |
| | 2nd Layer | 70 | 35,000 | | | | | | | |
| 3 | 1st Layer | 99 | 5,500 | 0.12 | 8 H | O | 8 | O | — | — |
| | 2nd Layer | 90 | 16,000 | | | | | | | |
| 4 | 1st Layer | 99 | 4,500 | 0.21 | 9 H | O | 8 | O | — | — |
| | 2nd Layer | 82 | 25,000 | | | | | | | |
| 5 | 1st Layer | 99 | 4,000 | 0.27 | 9 H | O | 8 | O | O | O |
| | 2nd Layer | 77 | 33,000 | | | | | | | |
| 6 | 1st Layer | 99 | 4,000 | 0.27 | 9 H | O | 8 | O | O | O |
| | 2nd Layer | 77 | 33,000 | | | | | | | |
| 7 | 1st Layer | 97 | 3,000 | 0.36 | 9 H | O | 10 | O | O | O |
| | 2nd Layer | 70 | 35,000 | | | | | | | |

TABLE 4-continued

| Nos. | Type of Protective Coat. | Characteristics & Evaluations of Surface Protective Layer: Transmissivity I (%) | Coefficient at 450 nm $\alpha 1, \alpha 2$ (cm−1) | $\alpha_1 \cdot D_1 + \alpha_2 \cdot D_2$ | Hardness | Sensitivity | Adhesive Property | Results of Environmental Tests | Copy Evaluation: Initial | After Repetition |
|---|---|---|---|---|---|---|---|---|---|---|
| 8 | 1st Layer | 99 | 3,000 | 0.36 | 9 H | ○ | 10 | ○ | ○ | ○ |
| | 2nd Layer | 70 | 35,000 | | | | | | | |
| 1 | Single Layer | 77 | 33,000 | 0.26 ($D_1 = 0$) | 9 H | ○ | 2 | ○ | X | — |
| 2 | Single Layer | 70 | 35,000 | 0.35 ($D_1 = 0$) | 9 H | ○ | 2 | ○ | X | — |
| 3 | Single Layer | 82 | 25,000 | 0.20 ($D_1 = 0$) | 9 H | ○ | 2 | ○ | X | — |

COMPARISONS 1 TO 3

Except that the first surface protective layers were not formed, the photosensitive mediums each having the surface protective layer were manufactured under such manufacturing conditions as tabulated in Table 3 according to a method similar to that used in Example 5 for the purpose of comparison.

Characteristics

The 450 nm absorption coefficient of each of the photosensitive mediums was determined according to a method similar to that employed in Example 1.

The JIS-K5400 pencil lead hardness test was also applied to each of the photosensitive mediums to determine the surface hardness of each of the resultant photosensitive mediums and indicated that the surface hardness rating exhibited by a portion of each photosensitive medium where the surface protective layer was bonded was found to be approximately 9 H which is comparable to those exhibited by the photosensitive mediums manufactured according to the present invention. The sensitivity characteristic of each photosensitive medium is substantially equivalent to that exhibited by the photosensitive layer used as the substrate 752 and, therefore, it is clear that the surface protective layer did not bring about any adverse effect on the sensitivity peculiar to the respective photosensitive medium.

However, the result of the JIS-K5400 adhesion test applied to each of the photosensitive mediums manufactured for the purpose of comparison has indicated that all of the photosensitive mediums gained 2 points or smaller and, therefore, the adhesive property between the photosensitive layer and the surface protective layer in each of the photosensitive mediums manufactured for the purpose of comparison was not sastisfactory enough to permit them to be utilizable in practice. This was evidenced by the result of experiment in which a plurality of line-shaped traces of separation were found in a direction circumferentially of each of the photosensitive mediums when the respective photosensitive medium was installed in the copying machine, EP-650Z, and was used for making several hundred copies.

The various test results discussed above are tabulated in Table 4.

Although the present invention has been described in connection with the preferred embodiment thereof with reference to the accompanying drawings, it is to be noted that various changes and modifications are apparent to those skilled in the art. Such changes and modifications are to be understood as included within the scope of the present invention as defined by the appended claims, unless they depart therefrom.

What is claimed is:

1. A photosensitive medium which comprises:

an electroconductive substrate;

an organic photosensitive layer formed on the substrate; and a surface protective layer formed on the photosensitive layer and including amorphous hydrocarbon, said surface protective layer including a first region overlaying the photosensitive layer and a second region overlaying the first region, said second region including amorphous hydrocarbon having a light absorption coefficient at a wavelength of 450 nm which is greater than 10,000 $cm^{-1}$, said first region including amorphous hydrocarbon having a light absorption coefficient which is relatively smaller than that of the second region and said second region having a thickness which is relatively greater than that of the first region.

2. The photosensitive medium as claimed in claim 1, wherein said organic photosensitive layer comprises a charge generating layer and a charge transporting layer.

3. The photosensitive medium as claimed in claim 1, wherein said second region including amorphous hydrocarbon having a light absorption coefficient at a wavelength of 450 nm which is greater than 20,000 $cm^{-1}$.

4. The photosensitive medium as claimed in claim 3, wherein said second region including amorphous hydrocarbon having a light absorption coefficient at a wavelength of 450 nm which is greater than 25,000 $cm^{-1}$.

5. The photosensitive medium as claimed in claim 1, wherein said first region includes amorphous hydrocarbon having a light absorption coefficient which is smaller than 10,000 $cm^{-1}$.

6. The photosensitive medium as claimed in claim 5, wherein said first region includes amorphous hydrocarbon having a light absorption coefficient at a wavelength of 450 nm which is smaller than 9,000 $cm^{-1}$.

7. The photosensitive medium as claimed in claim 6, wherein said first region includes amorphous hydrocarbon having a light absorption coefficient at a wavelength of 450 nm which is smaller than 6,000 $cm^{-1}$.

8. The photosensitive medium as claimed in claim 1, wherein said first region has a thickness within the range of 0.006 to 0.5 μm.

9. The photosensitive medium as claimed in claim 8, wherein said first region has a thickness within the range of 0.01 to 0.2 μm.

10. The photosensitive medium as claimed in claim 1, wherein said second region has a thickness within the range of 0.01 to 5 μm.

11. The photosensitive medium as claimed in claim 10, wherein said second region has a thickness within the range of 0.04 to 1 μm.

12. The photosensitive medium as claimed in claim 1, wherein said surface protective layer has a thickness within the range of 002 to 5 μm.

13. The photosensitive medium as claimed in claim 1, wherein the absorbent coefficient $\alpha_1$ of the first region at the wavelength of 450 nm, the absorbent coefficient $\alpha_2$ of the second region at the wavelength of 450 nm, the thickness $D_1$ of the first region and the thickness $D_2$ of the second region have the following relationship:

$$\alpha_1 \times D_1 + \alpha_2 \times D_2 \leqq 0.69$$

14. The photosensitive medium as claimed in claim 13, wherein the absorbent coefficient $\alpha_1$ of the first region at the wavelength of 450 nm, the absorbent coefficient $\alpha_2$ of the second region at the wavelength of 450 nm, the thickness of $D_1$ of the first region and the thickness $D_2$ of the second region have the following relationship:

$$\alpha_1 \times D_1 + \alpha_2 \times D_2 \leqq 0.51$$

15. A photosensitive medium which comprises:
an electroconductive substrate;
a photosensitive layer formed on the substrate; and
a surface protective layer formed on the photosensitive layer and including amorphous hydrocarbon, said surface protective layer including a first region overlaying the photosensitive layer and a second region overlaying the first region, said second region including amorphous hydrocarbon having a light absorption coefficient at a wavelength of 450 nm which is greater than a 10,000 $cm^{-1}$, said first region including amorphous hydrocarbon having a light absorption coefficient which is relatively smaller than that of the second region and said second region having a thickness which is relatively greater than that of the first region.

16. The photosensitive medium as claimed in claim 15, wherein said second region including amorphous hydrocarbon having a light absorption coefficient at a wavelength of 450 nm which is greater than 20,000 $cm^{-1}$.

17. The photosensitive medium as claimed in claim 15, wherein said first region including amorphous hydrocarbon having a light absorption coefficient which is smaller than 10,000 $cm^{-1}$.

18. The photosensitive medium as claimed in claim 17, wherein said region including amorphous hydrocarbon having a light absorption coefficient at a wavelength of 450 nm which is smaller than 9,000 $cm^{-1}$.

19. The photosensitive medium as claimed in claim 15, wherein said first region has a thickness within the range of 0.006 to 0.5 μm.

20. The photosensitive medium as claimed in claim 15, wherein said second region has a thickness within the range of 0.01 to 5 μm.

21. The photosensitive medium as claimed in claim 15, wherein said photosensitive layer includes a selenium type photoconductive material.

22. The photosensitive medium as claimed in claim 15, wherein said photosensitive layer includes amorphous silicon.

23. A photosensitive medium which comprises:
an electroconductive substrate;
a photosensitive layer formed on the substrate; and
a surface protective layer formed on the photosensitive layer and including a film of amorphous hydrocarbon, said surface protective layer having a light absorption coefficient at a wavelength of 450 nm which is maximum at an outermost surface region thereof and minimum at a portion thereof adjacent the photosensitive layer said surface protective layer having a region in which a light absorption coefficient at a wavelength of 450 nm is greater than 10,000 $cm^{-1}$, said region occupying a thickness of more than half of said surface protective layer.

24. The photosensitive medium as claimed in claim 23, wherein said light absorption coefficient at the outermost surface region is greater than 10,000 $cm^{-1}$.

25. The photosensitive medium as claimed in claim 23, wherein said surface protective layer has a thickness within the range of 0.02 to 5 μm.

26. The photosensitive medium as claimed in claim 23, wherein said photosensitive layer includes organic photoconductive material.

27. The photosensitive medium as claimed in claim 23, wherein said photosensitive layer includes a selenium type photoconductive material.

28. The photosensitive medium as claimed in claim 23, wherein said photosensitive layer includes amorphous silicon.

* * * * *